US006000370A

United States Patent [19]

Rickard

[11] Patent Number: 6,000,370

[45] Date of Patent: Dec. 14, 1999

[54] COMPRESSION RELEASE MECHANISM FOR AN INTERNAL COMBUSTION ENGINE

[75] Inventor: Harry Gene Rickard, Phoenix, Ariz.

[73] Assignee: Ryobi North America, Inc.

[21] Appl. No.: 08/974,771

[22] Filed: Nov. 20, 1997

[51] Int. Cl.[6] ..... F02N 17/00

[52] U.S. Cl. ..... 123/182.1

[58] Field of Search ..... 123/182.1; 417/299

[56] References Cited

U.S. PATENT DOCUMENTS

| | | | |
|---|---|---|---|
| 2,742,380 | 4/1956 | Peters | 123/182.1 |
| 3,418,992 | 12/1968 | Anderson et al. | 123/182.1 |
| 4,217,796 | 8/1980 | Donohue | 477/111 |
| 4,257,367 | 3/1981 | Fujikawa et al. | 123/185.4 |
| 4,369,741 | 1/1983 | Perrin | 123/182.1 |
| 5,007,391 | 4/1991 | Nomoto | 123/182.1 |
| 5,116,287 | 5/1992 | Hironaka et al. | 123/182.1 |
| 5,241,932 | 9/1993 | Everts | 123/195 R |
| 5,379,734 | 1/1995 | Tsunoda et al. | 123/182.1 |
| 5,492,096 | 2/1996 | Isaacs | 123/396 |
| 5,558,057 | 9/1996 | Everts | 123/195 R |

*Primary Examiner*—Andrew M. Dolinar
*Attorney, Agent, or Firm*—Brooks & Kushamn P.C

[57] ABSTRACT

A compression release mechanism for a combustion chamber in an internal combustion engine comprises a pressure relief valve assembly and a control member. The valve assembly includes a valve body and a plunger cooperating with a vent passageway through the valve body to selectively allow pressure relief through the vent passageway. The control member cooperates with the plunger and is movable between an engaged position in which the control member urges the plunger toward the open position, and a disengaged position in which the plunger is held in the closed position. When the control member is engaged, the plunger oscillates between the open and closed positions in response to combustion chamber pressures during a combustion cycle which facilitates engine start-up while the compression release mechanism is engaged.

7 Claims, 3 Drawing Sheets

COMPRESSION RELEASE MECHANISM FOR AN INTERNAL COMBUSTION ENGINE

TECHNICAL FIELD

The present invention relates to compression release mechanisms for use in internal combustion engines.

BACKGROUND ART

The use of tools having internal combustion engines have become widespread. For example, chainsaws, line trimmers, and lawn mowers are commonly powered by internal combustion engines. These tools are either manually started by pulling a pull cord, or are equipped with a battery-powered starter. In both manually started and battery-power started engines, a large cranking torque is required to initiate engine firing.

In the prior art, several attempts have been made to provide compression release mechanisms to reduce the initial cranking torque required for engine starting. For example, U.S. Pat. No. 5,492,096 issued to Isaacs et al. discloses a compression release system to conserve battery power of a starter assembly.

SUMMARY OF THE INVENTION

It is therefore an object of the present invention to provide an improved compression release mechanism for an internal combustion engine.

It is another object of the present invention to reduce the pull effort of the pull cord in a manual start internal combustion engine.

It is another object of the present invention to provide a compression release mechanism which allows operation of an internal combustion engine at reduced compression for a short warm-up period.

In carrying out the above objects and other objects and features of the present invention, a compression release mechanism is provided. The compression release mechanism comprises a pressure relief valve assembly and a cooperating control member. The valve assembly includes a valve body defining a vent passageway having an inlet in fluid communication with the combustion chamber. The vent passageway has an outlet external to the combustion chamber. A plunger cooperates with the vent passageway to selectively allow pressure relief through the vent passageway.

The plunger is movable between an open position which allows pressure relief through the vent passageway, and a closed position which blocks pressure relief through the vent passageway. The control member of the compression release mechanism is movable between engaged and disengaged positions. The plunger is urged toward the open position when the control member is in the engaged position. While the control member is engaged, the plunger oscillates between the open and closed positions in response to combustion chamber pressures during a combustion cycle. When the control member is in the disengaged position, the plunger is held in the closed position.

In one embodiment, a choke mechanism for the internal combustion engine controls an air/fuel ratio delivered to the combustion chamber. A choke actuation switch is movable between at least one choke position and a run position. The choke switch is connected to the control member so that the movement of the choke switch to any one of the choke positions engages the control member which opens the pressure relief valve. Movement of the choke switch to the run position disengages the control member which closes the pressure relief valve, and disengages the engine choke mechanism.

The advantages accruing to the present invention are numerous. For example, the compression release mechanism of the present invention reduces the required cranking torque to start both manual start and automatic start internal combustion engines. Further, the present invention allows the engine to run at reduced compression to facilitate engine starting while the compression release mechanism is engaged.

The above objects and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
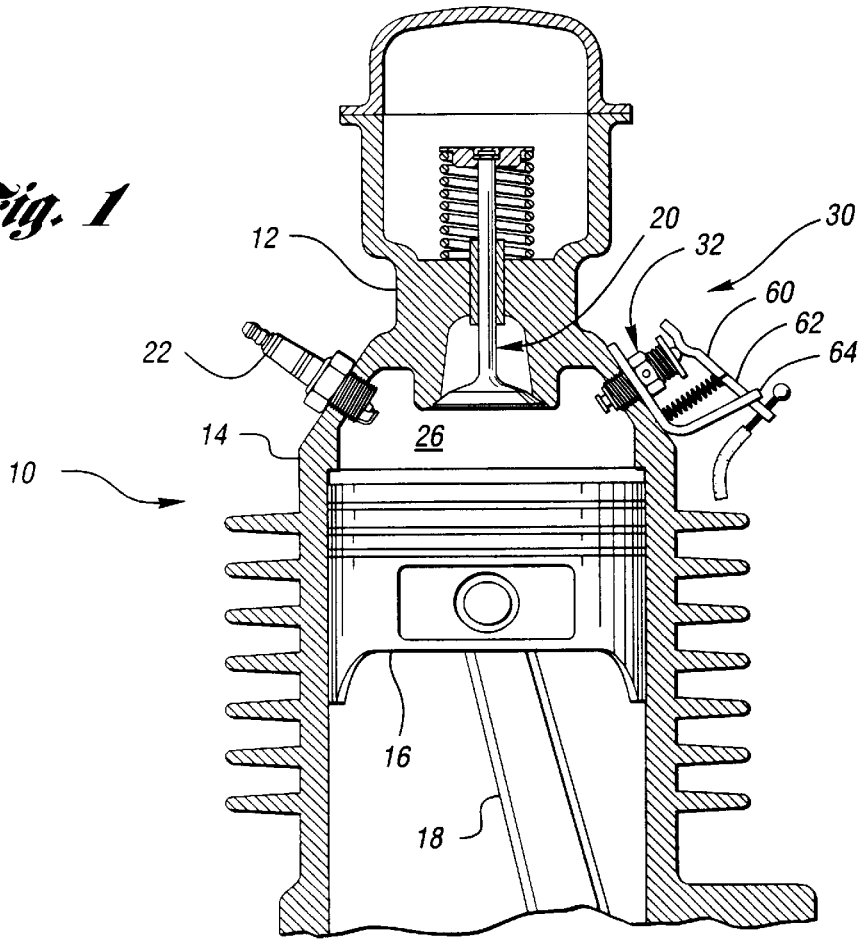
FIG. 1 is an internal combustion engine having a compression release mechanism of the present invention.
Figure 2:
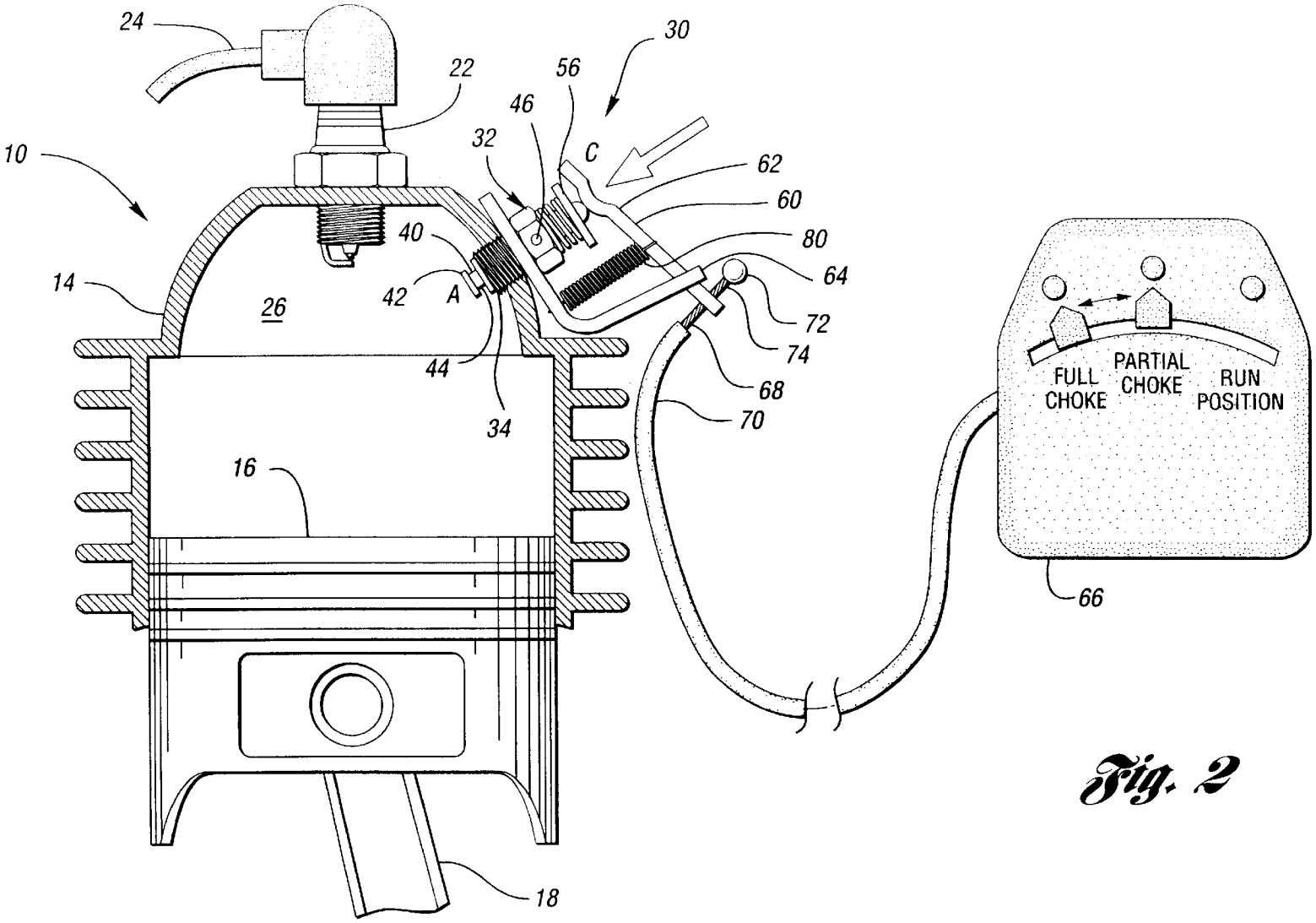
FIG. 2 is a compression release mechanism of the present invention connected to a choke lever, depicted in a full or partial choke position.
Figure 3:
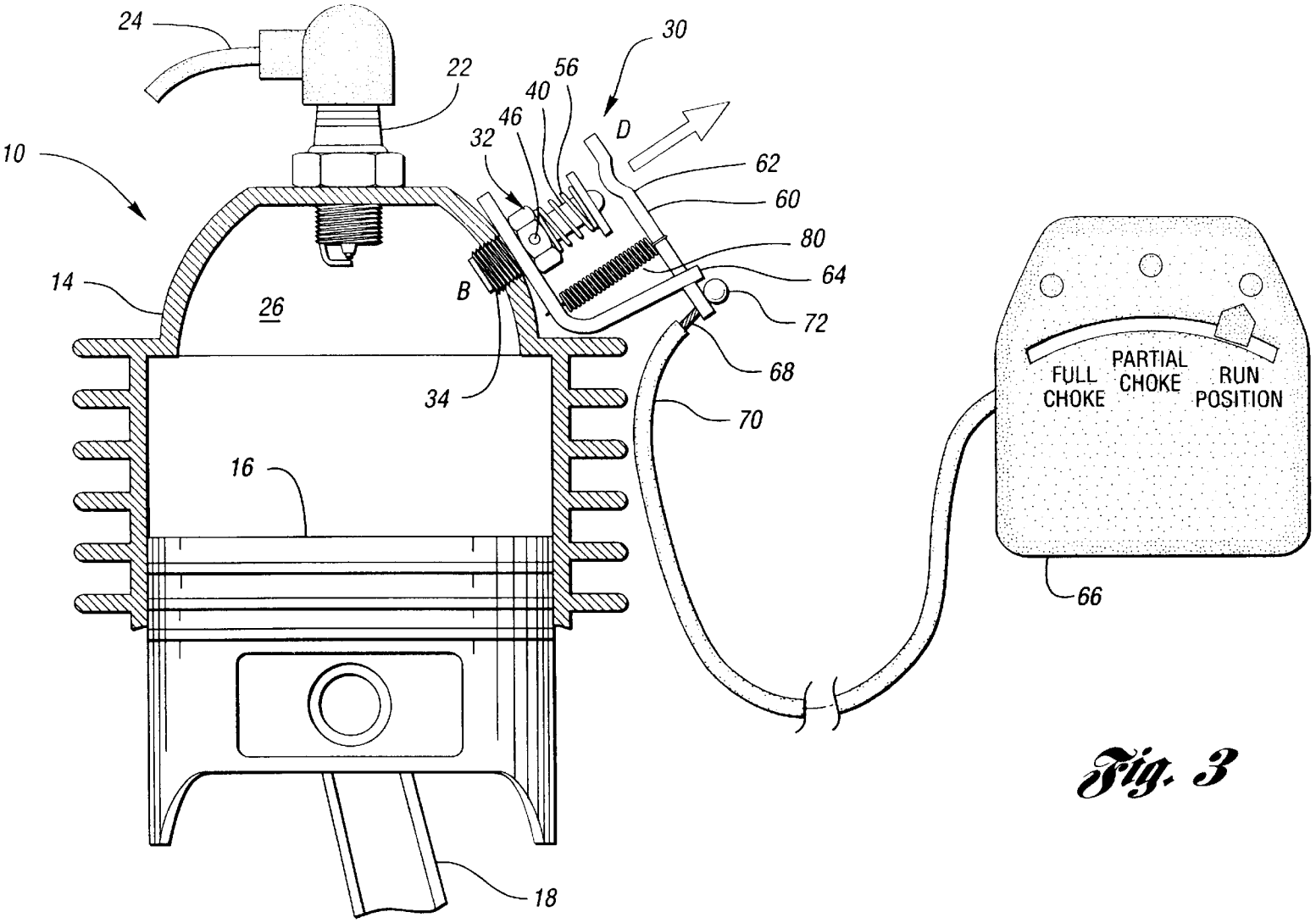
FIG. 3 is the compression release mechanism of FIG. 2, depicted with the choke lever in the run position.

Referring to FIGS. 1–3, an internal combustion engine is generally indicated at 10. The internal combustion engine 10 includes a housing 12, which defines a cylinder 14. A piston 16 is received in the cylinder 14 and is connected to a crankshaft (not shown) by connecting rod 18. Conventional poppet valve assem blies, such as valve assembly 20 (FIG. 1) control intake inlets and exhaust outlets as is known in the art of internal combustion engines. A spark plug 22 having ignition wire 24 (FIGS. 2–3) provide an ignition spark to the combustion chamber 26 to ignite fuel during a compression stroke, as known in the art. The present invention can be used both on four-cycle engines of the type illustrates as well as two-cycle engines most commonly used in portable power tools such as line trimmers, chainsaws, and the like. As a way of general background of the engine environment in which the present invention can be utilized, U.S. Pat. No. 5,116,287 illustrates a two-cycle engine and U.S. Pat. No. 5,558,057 illustrates a four-cycle engine, both of which are incorporated by reference herein.

Figure 4:
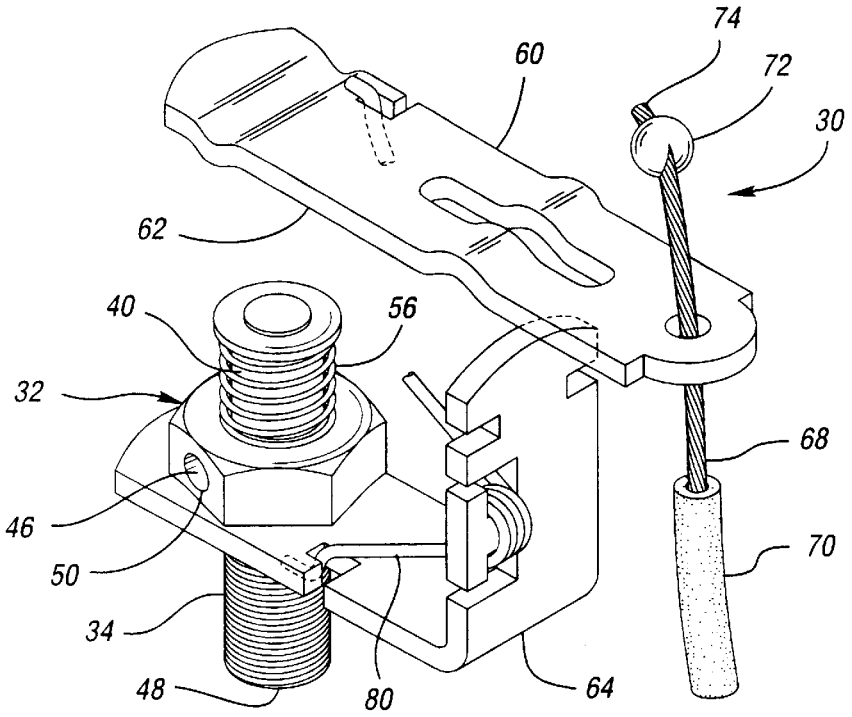
FIG. 4 is another embodiment of a compression release mechanism of the present invention.

Referring now to FIGS. 1–4, primarily to FIG. 4, a compression release mechanism 30 for releasing pressure from combustion chamber 26 in internal combustion 10 is shown. Compression release mechanism 30 includes a pressure relief valve assembly, generally indicated at 32. Valve assembly 32 has a valve body 34 having threads on one of its ends. Valve body 34 is threaded into a threaded bore in cylinder 14 in communication with the combustion chamber 26. Valve assembly 32 further includes a plunger 40. The plunger 40 has a head 42 and a body portion 44, as best illustrated in FIG. 2. The plunger 40 is movable between an open position, indicated at A (FIG. 2), and a closed position indicated at B (FIG. 3). Valve body 34 defines a vent passageway 46 having an inlet 48 in fluid communication with the combustion chamber 26. Vent passageway 46 has an outlet 50 external to the combustion chamber 26.

The plunger 40 cooperates with the vent passageway 46 to selectively allow pressure relief through the vent passageway 46. When plunger 40 is in the open position A (FIG. 2), combustion chamber pressure may be relieved through vent passageway 46. When plunger 40 is in the closed position B (FIG. 3), pressure relief through the vent passageway 46 is blocked by plunger 40. In the embodiment illustrated, plunger head 42 will rest upon a seating surface to cut off communication between combustion chamber 26 and vent passageway 46. A plunger spring 56 biases the plunger 40 toward the closed position B (FIG. 3).

A control member 60, shown as a lever 62 pivotally mounted to a base 64, is movable between an engaged position, indicated at C (FIG. 2), and a disengaged position, indicated at D (FIG. 3). Movement of the control member 60 to the engaged position C urges plunger 40 toward the open position A (FIG. 2) against the bias of plunger spring 56. Movement of control member 60 to the disengaged position D allows the plunger spring 56 to hold plunger 40 in the closed position B (FIG. 3) as described previously.

With continuing reference to FIGS. 1–4, primarily to FIGS. 2–3, a control member spring 80 biases control member 60 to the engaged position C (FIG. 2). It is to be appreciated that control member spring 80 may be a coil-type tension spring as shown in FIGS. 1–3, or a torsion spring as shown in FIG. 4.

A choke mechanism controls an air/fuel ratio delivered to combustion chamber 26 of internal combustion engine 10. Typically, a choke mechanism is provided to facilitate start-up of a cold engine without flooding it with fuel. As shown, the choke mechanism is controlled by a choke switch 66 movable between at least one choke position and a run position. A cable 68 covered by sheath 70 connects choke switch 66 to the control member 60. A crump-on lead ball 72 is located at one end 74 of cable 68.

With reference to FIG. 3, movement of choke switch 66 to the run position disengages control member 60 from plunger 40 and the associated inward bias of control member spring 80. This allows plunger spring 56 to bias the plunger 40 to the closed position B, blocking pressure relief through vent passageway 46. The engine will then operate at full combustion chamber compression.

With continuing reference to FIG. 2, movement of choke switch 66 to either the full choke or the partial choke position pushes ball 72 away from control member 60. This allows control member spring 80 to bias the control member 60 to the engaged position C. Further, engagement of the control member 60 biases the plunger 40 to the open position A overcoming the outward bias of plunger spring 56.

In operation when control member 60 is in the engaged position C, the plunger 40 oscillates between the open and closed positions in response to combustion chamber pressures acting on the plunger 40 during a combustion cycle and the net inward spring load exerted on plunger 40 by springs 56 and 80. The engine will then operate at reduced combustion pressure as the plunger 40 reciprocates between the open and closed position during each engine cycle. Once the engine has started to run and has warmed up, the control member is returned to the disengaged position.

It is to be appreciated that the present invention facilitates pulling the pull cord in a manual start type engine. By selecting the plunger spring 56 and the control member spring 80 such that the plunger 40 will oscillate between the open and closed positions in response to combustion chamber pressures, the engine is able to run while the compression release is engaged and the choke switch is in the partial choke position. Varying the net spring load or the plunger geometry will determine the amount of compression release which occurs before the plunger closed due to combustion gas pressure. The amount of compression relief is also dictated by the amount of plunger lift. In the embodiment disclosed when the engine is set to the full choke position, lever 62 biases plunger 40 to the maximum lift state, thereby achieving maximum compression release. When the choke is moved to the partial choke position, lever 62 is displaced less, causing plunger 40 to be at a lower lift than when the engine was set to full choke. The lower plunger lift causes the plunger to close quicker, thereby reducing the amount of compression release which occurs. Accordingly, each time that the user pulls the pull cord during start-up, the cranking torque is reduced by the compression release mechanism. After the engine is running, the user may simply disengage the pressure release mechanism and the engine choke mechanism by moving the choke switch 66 to the run position.

It is further to be appreciated that the compression release mechanism 30 need not be connected to choke switch 66. A separate compression release mechanism lever may be used to control the compression release mechanism 30 independent of any engine choke mechanisms.

Although the present invention has been described in considerable detail with reference to certain preferred versions thereof, other versions are possible. For example, the compression release mechanism illustrated employs a normally closed valve assembly 32 which is held open by control member 60 to start the engine 10. In an alternative embodiment, a normally open valve assembly may be provided, which is held closed to run the engine at full compression, and left open to start the engine.

While the best mode for carrying out the invention has been described in detail, those familiar with the art to which this invention relates will recognize various alternative designs and embodiments for practicing the invention as defined by the following claims.

What is claimed is:

1. A compression release mechanism for a combustion chamber forming a space above a piston at the top of its travel in a spark ignition internal combustion piston engine, the compression release mechanism comprising:

a pressure relief valve assembly having a valve body and a plunger, the valve body defining a vent passageway having an inlet in fluid communication with the combustion chamber and an outlet external to the combustion chamber, the plunger cooperating with the vent passageway to selectively allow pressure relief through the vent passageway, the plunger being moveable between an open position which allows pressure relief through the vent passageway, and a closed position which blocks pressure relief through the vent passageway; and a control member cooperating with the plunger and being moveable between an engaged position in which the control member urges the plunger toward the open position wherein the plunger oscillates between the open and closed positions in response to combustion chamber pressures during a combustion cycle, and a disengaged position in which the plunger is held in the closed position.

2. The compression release mechanism of claim 1 wherein the control member further comprises:

a plunger spring biasing the plunger toward the closed position, wherein the movement of the control member to the engaged position urges the plunger toward the open position against the bias of the plunger spring, and the movement of the control member to the disengaged position allows the plunger spring to hold the plunger in the closed position.

3. The compression release mechanism of claim 1 wherein the control member further comprises:

a control member spring biasing the control member toward the engaged position;

a lever moveable between first and second positions; and a cable connecting the lever to the control member, wherein movement of the lever to the first position allows movement of the control member to the engaged position under the bias of the control member spring, and movement of the lever to the second position moves the control member to the disengaged position against the bias of the control member spring.

4. In an internal combustion spark ignition piston engine having a combustion chamber forming a space above the piston at the top of its travel and a choke mechanism to control the air/fuel ratio of the intake charge delivered to the combustion chamber, the improvement comprising:

a pressure relief valve assembly having a valve body and a plunger, the valve body defining a vent passageway having an in let in fluid communication with the combustion chamber and an outlet external to the combustion chamber, the plunger cooperating with the vent passageway to selectively allow pressure relief through the vent passageway, the plunger being moveable between an open position which allows pressure relief through the vent passageway, and a closed position which blocks pressure relief through the vent passageway;

a control member cooperating with the plunger and being moveable between an engaged position in which the control member urges the plunger toward the open position wherein the plunger oscillates between the open and closed positions in response to combustion chamber pressures during a combustion cycle, and a disengaged position in which the plunger is held in the closed position; and a choke switch moveable between at least one choke position and a run position, the choke switch being connected to the choke mechanism to control the air/fuel ratio, and the choke switch being connected to the control member wherein the movement of the choke switch to the at least one choke position engages the control member, and movement of the choke switch to the run position disengages the control member.

5. The improvement of claim 4 wherein the control member further comprises:

a plunger spring biasing the plunger toward the closed position, wherein the movement of the control member to the engaged position urges the plunger toward the open position against the bias of the plunger spring, and the movement of the control member to the disengaged position allows the plunger spring to hold the plunger in the closed position.

6. A compression release mechanism for a combustion chamber forming a space above a piston at the top of its travel in a spark ignition internal combustion piston engine, the compression release mechanism comprising:

a pressure relief valve assembly having a valve body and a plunger, the valve body defining a vent passageway having an inlet in fluid communication with the combustion chamber and an outlet external to the combustion chamber, the plunger cooperating with the vent passageway to selectively allow pressure relief through the vent passageway, the plunger being moveable between an open position which allows pressure relief through the vent passageway, and a closed position which blocks pressure relief through the vent passageway;

a plunger spring biasing the plunger toward the closed position; and a control member cooperating with the plunger and being moveable between an engaged position in which the control member urges the plunger toward the open position against the bias of the plunger spring wherein the plunger oscillates between the open and closed positions in response to combustion chamber pressures during a combustion cycle, and a disengaged position in which the plunger is held in the closed position by the plunger spring.

7. The compression release mechanism of claim 6 wherein the control member further comprises:

a control member spring biasing the control member toward the engaged position;

lever moveable between first and second positions; and a cable connecting the lever to the control member, wherein movement of the lever to the first position allows movement of the control member to the engaged position under the bias of the control member spring, and movement of the lever to the second position moves the control member to the disengaged position against the bias of the control member spring.

* * * * *